United States Patent [19]

Cartwright et al.

[11] Patent Number: 4,545,761

[45] Date of Patent: Oct. 8, 1985

[54] METHOD AND APPARATUS FOR SECURING ARTICLES IN PLACE ON A SUBSTRATE

[75] Inventors: John S. Cartwright, Hopewell Township, Mercer County, N.J.; Jerry C. Hurst, Muhlenberg Township, Berks County, Pa.

[73] Assignee: AT&T Technologies, Inc., Berkeley Heights, N.J.

[21] Appl. No.: 680,003

[22] Filed: Dec. 10, 1984

[51] Int. Cl.[4] ..... F27D 5/00

[52] U.S. Cl. ..... 432/5; 432/253

[58] Field of Search ..... 432/5, 253, 258; 228/212; 219/85 E, 85 M

[56] References Cited

U.S. PATENT DOCUMENTS

| | | | |
|---|---|---|---|
| 2,406,310 | 8/1946 | Agule | 113/112 |
| 2,411,439 | 11/1946 | Lee | 113/112 |
| 4,259,061 | 3/1981 | Dubetsky | 432/258 |
| 4,503,597 | 3/1985 | Kushima et al. | 219/85 E |

*Primary Examiner*—John J. Camby

*Attorney, Agent, or Firm*—D. J. Kirk; J. S. Codispoti

[57] ABSTRACT

A spring clip (30) for holding chip carriers in place on a pallet (20) serves to urge a case (12) seated in each of a plurality of pallet cavities (22) against an underlying lid (14) therein during fabrication of the chip carrier (10). The spring clip (30) comprises a central shaft (32) which extends vertically through the center of a metal plate (31). The plate (31) has a plurality of radially outstretched resilient arms (36), each sloping downwardly from a separate side thereof and having an upturned end (37). The lower end (38) of the shaft (32) is sized for lockable engagement with a corresponding one of a plurality of receiving passages (24) in the pallet (20). Each passage (24) is surrounded by a group of pallet cavities (22). When the first end of each shaft (32) of the spring clip (30) is lockably engaged with the pallet (20), the chip carriers (10) are held on the pallet (20) by the ends (37) of the arms (36).

20 Claims, 7 Drawing Figures

METHOD AND APPARATUS FOR SECURING ARTICLES IN PLACE ON A SUBSTRATE

TECHNICAL FIELD

This invention relates to a technique for securing a plurality of articles on a substrate.

BACKGROUND OF THE INVENTION

Only recently have chip carriers been developed for the packaging of semiconductor chips. A chip carrier is typically comprised of a case having a cavity therein in which a semiconductor chip is fixedly mounted. The semiconductor chip is connected, either by way of solid wires or leads which extend through the case, to bonding pads on the exterior thereof to permit electrical connection to the chip. The case is covered by a lid which is hermetically sealed thereto.

To assure the hermetic seal between the case and the lid, a thin film of a eutectic alloy is deposited in an earlier process on the periphery of a major surface of the lid which will contact its associated case. The alloy will reflow when heated and, upon subsequent cooling, will form the desired seal. The case must be maintained in intimate contact with the lid during heating thereof to prevent the lid from floating during the reflow of the eutectic alloy. In the past, various types of spring clips have been used to apply pressure to the lid and case during heating. One such spring clip has the configuration similar to that of a clothespin where the case and the lid of a chip carrier are held closely to one another between the tines of the spring clip. This type of clip can be configured to typically hold six chip carriers. The clip itself, with the captured chip carriers therein, is ultimately placed in a furnace to reflow the solder to seal the lids onto the cases.

These prior spring clips have not proven satisfactory from the standpoint that they must be manually employed. This necessarily results in slow packaging time and incurs additional expenses in the form of increased labor costs. Secondly, these prior spring clips are not easily adaptable to high volume production of chip carriers because of the additional time required to arrange a sizable number for large-scale simultaneous heating.

Therefore, there is a need for a spring clip adaptable to an automated and a high volume assembly of chip carriers which also holds the lid in intimate contact with the chip carrier cases during the heating thereof.

SUMMARY OF THE INVENTION

The foregoing problems are obviated by one aspect of the invention which is an apparatus comprising an elongated central member having first and second ends, means at the first end of the central member for lockably engaging a substrate, and a plurality of resilient arms extending radially out from the central member, for contacting and securing articles on the substrate in place when the first end of the central member is lockably engaged in the substrate.

Advantageously, the use of the instant apparatus which is amenable to an automated assembly process insures reliability of packaging by reducing labor and essentially replaces the workmanship required by the prior apparatus. In addition, the packaging operation is converted from a low volume and costly process to a high volume and less expensive one because a large number of chip carriers can be assembled quickly and sealed simultaneously by utilizing the apparatus and the pallet.

BRIEF DESCRIPTION OF THE DRAWINGS

For a better understanding of the invention, reference is made to the following description of an exemplary embodiment thereof, and to the accompanying drawings, wherein.

DETAILED DESCRIPTION

Figure 1A:
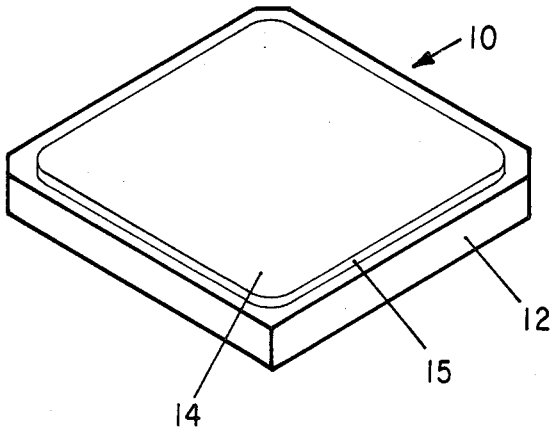
FIG. 1*a* is a top isometric view of a semiconductor chip carrier.
Figure 1B:
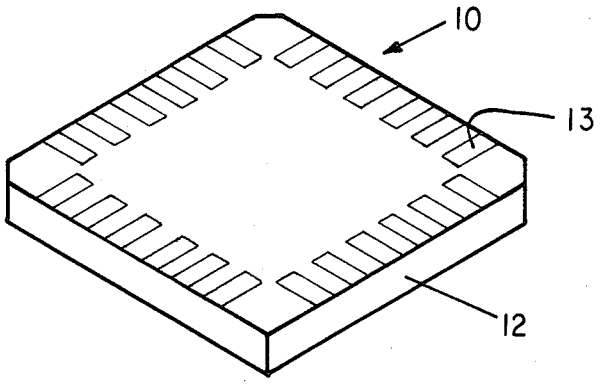
FIG. 1*b* is a bottom isometric view of the semiconductor chip carrier of FIG. 1*a;*

As illustrated in FIGS. 1*a,* 1*b* a chip carrier 10 is typically comprised of a case 12 having a cavity therein in which a semiconductor chip (not shown) is fixedly mounted. The semiconductor chip is connected, either by way of solid wires or leads which extend through the case 12, to bonding pads 13 on the exterior thereof to permit electrical connection to the chip. The case 12 is covered by a lid 14 which is hermetically sealed thereto by a thin film of eutectic alloy 15 such as 10UC Soldex alloy manufactured by Zirmex, Inc. of Tuscon, Ariz. The alloy 15 is deposited during an earlier process on the periphery of a major surface of the lid 14 which will contact the case 12.

Figure 2A:
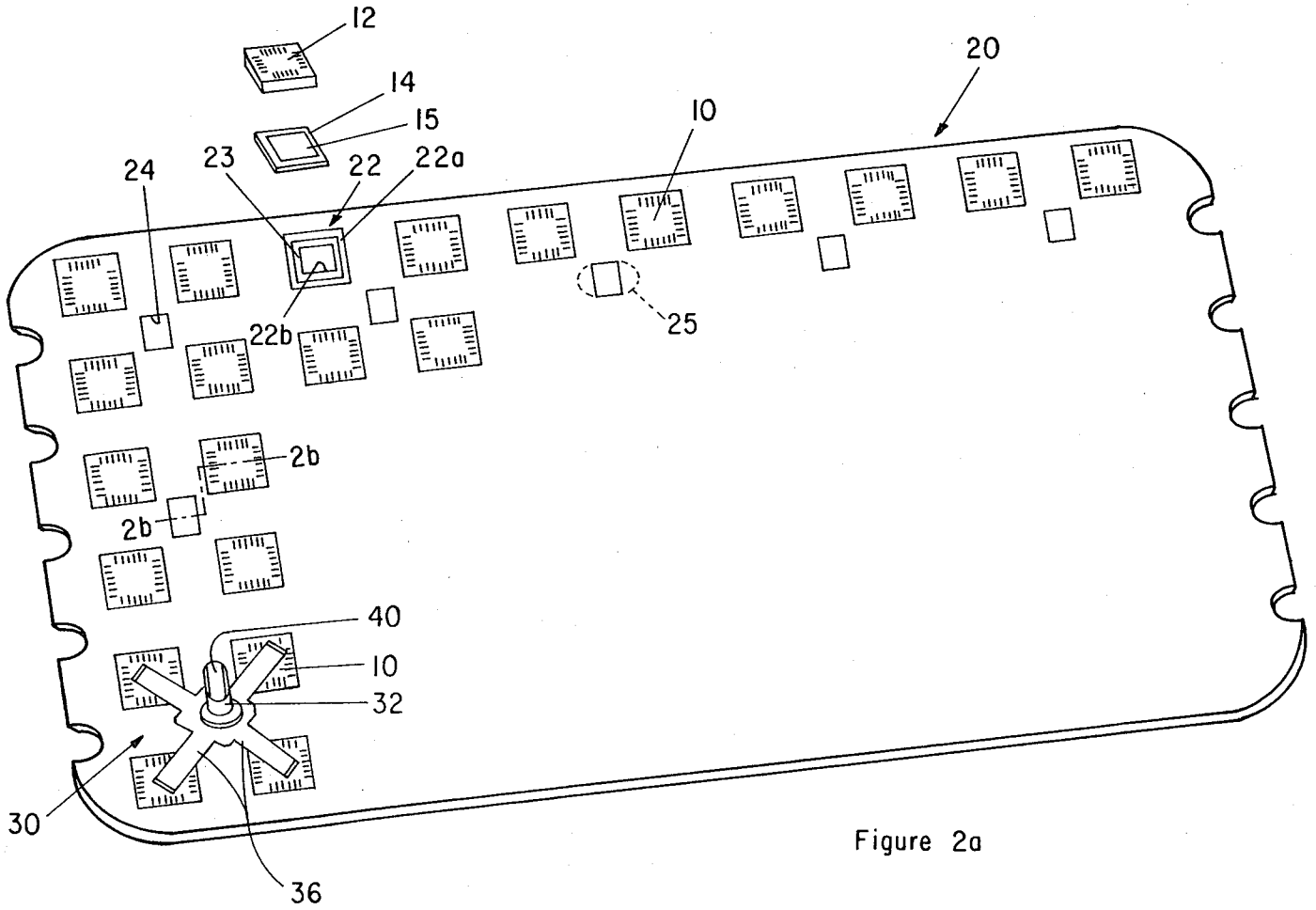
FIG. 2*a* is a top isometric view of a pallet containing the components of a chip carrier of FIGS. 1*a,* 1*b* and a spring clip.

FIG. 2*a* shows the structure of a pallet 20 which is utilized to contain and transport the components (i.e., the case 12 and the lid 14) of the chip carriers 10 through the assembly process. The pallet 20 has formed therein a plurality of through cavities 22 (one shown). Each cavity 22 has a tapered opening 22*a* in the upper portion thereof and an opening 22*b* in the lower portion surrounded by a ledge 23 for supporting a lid 14. Each cavity 22 is sized and shaped to permit receipt of a case 12 above an associated underlying lid 14 (see also FIG. 2*b*). In an exemplary embodiment, the cavities 22 are arranged in a ten row by six column array.

Figure 2B:
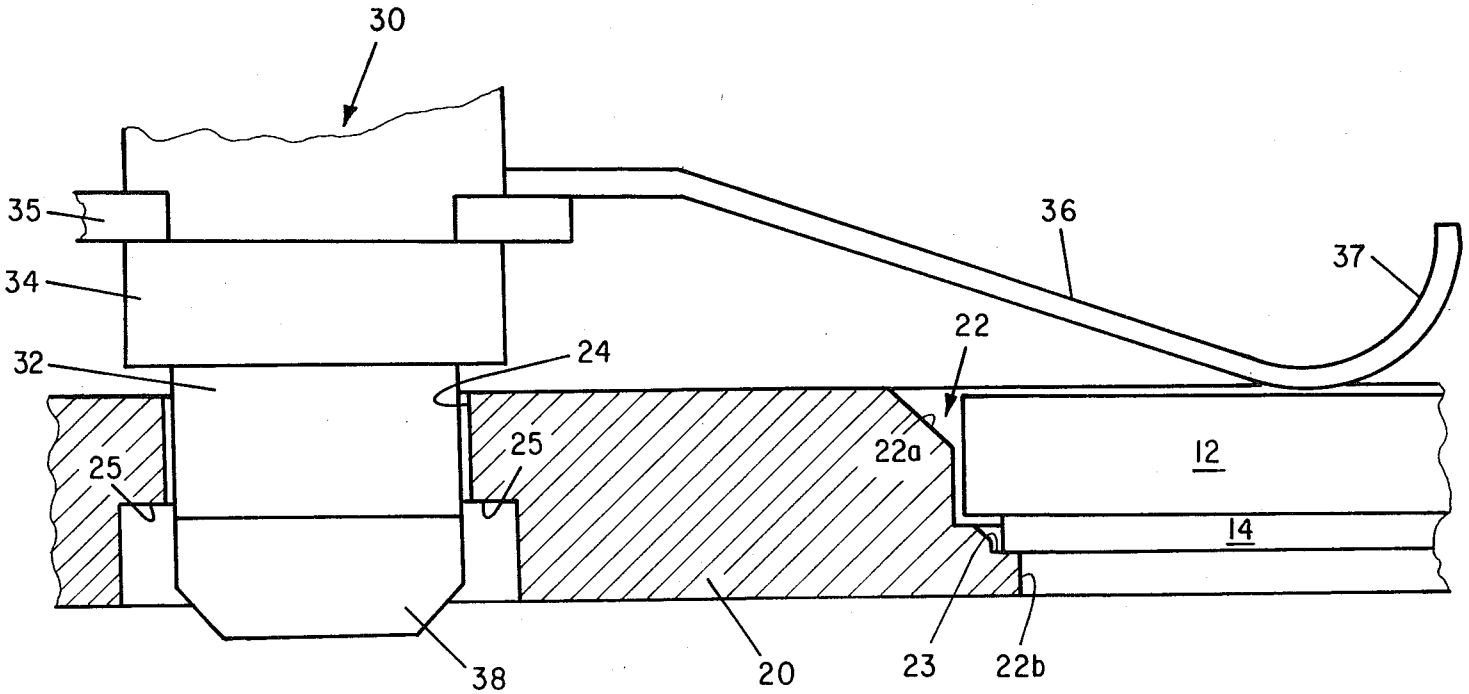
FIG. 2*b* is a partial cross-sectional view of a receiving passage and a cavity of the pallet of FIG. 2*a;*

The pallet 20 also has formed therein a plurality of through receiving passages 24 (also see FIG. 2*b*). The passages 24 are arranged in a five row by three column array in such a manner that a group of four cavities 22 surround one passage 24. FIG. 2*b* shows a cross-sectional view of the receiving passage 24 having shoulders 25 formed therein and a cavity 22 having a chip carrier lid 14 and a case 12 positioned therein. Also depicted in FIGS. 2*a,* 2*b* is a spring clip 30 which is inserted into a corresponding passage 24.

Figure 3:
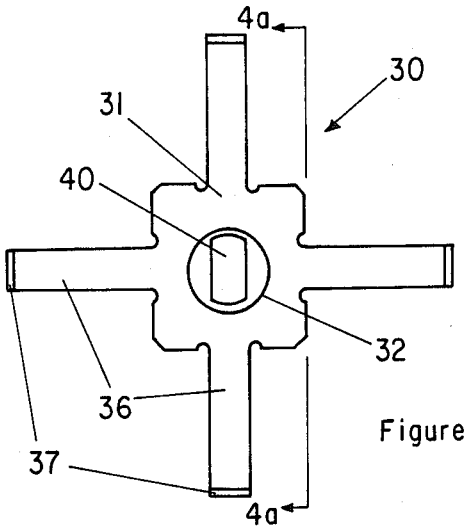
FIG. 3 is a top view of the spring clip which is inserted in the pallet of FIGS. 2*a,* 2*b;*
Figure 4A:
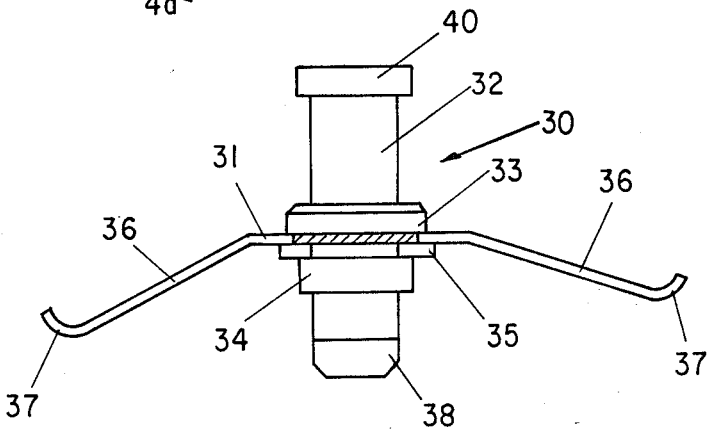
FIG. 4*a* is a cross-sectional view of the spring clip taken along 4*a*—4*a* shown in FIG. 3.
Figure 4B:
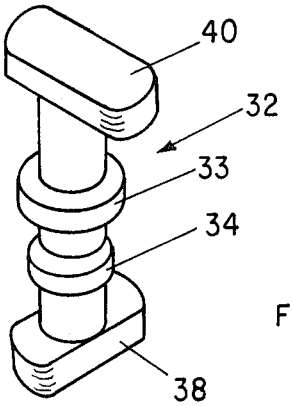
FIG. 4*b* is an isometric view of a shaft component of the spring clip of FIGS. 3, 4*a.*

FIGS. 3, 4*a* and 4*b* show top, side and isometric views, respectively, of the spring clip 30 in detail. The spring clip 30 comprises an elongated member or central shaft 32 which extends through a passage (not shown) in a thin square metal plate 31. The metal plate 31 is loosely carried on the central shaft 32 between a pair of annular spaced-apart shoulders 33,34. In practice, the outer diameter of the lower shoulder 34 is smaller than the diameter of the passage through the plate 31 which in turn is smaller than the outer diameter of the upper shoulder 33. A small "e" ring 35 engages the central shaft 32 above the shoulder 34 to keep the metal plate 31 from slipping off the shaft 32. The plate 31 has four outstretched resilient arms 36, each sloping downwardly from a separate one of the sides thereof. Typically, each arm 36 has an upturned end 37.

As shown in FIG. 4*b*, the lower end 38 of the central shaft 32 is oblong-shaped and is sized for insertion into a corresponding through receiving passage 24 in the pallet 20. The upper end 40 of the central shaft 32 also has an oblong shape whose long dimension is oriented 90° from that of the lower end 38. Note that the long dimensions of the lower and upper ends 38 and 40, respectively, are each substantially normal to the axis of the central shaft 32.

Referring to FIG. 2*b*, in order to insert the spring clip 30 into a receiving passage 24, the shaft 32 is rotated such that the orientation of the long dimension of its lower end 38 is in alignment with the length of the surface opening of the passage 24. The shaft 32 is then inserted into the passage 24 without resistance because the upper dimension of the passage 24 is sized to accept the lower end 38. As the shaft 32 is inserted, the ends 37 of the arms 36 initially contact the chip carrier cases 12 also without resistance. Thereafter, a downward force must be exerted to continue the shaft 32 insertion. The shaft 32 enters the passage 24 until the annular shoulder 34 contacts the surface of pallet 20 and entry is stopped. The shaft 32 is then rotated once more in order that the long dimension of the lower end 38 is oriented 90° from its bearing when it was initially inserted. The long dimension of the lower end 38 is effectively positioned underneath the passage shoulders 25 and, consequently, the spring clip 30 cannot be lifted out of passage 24. The tolerances involved are such that arms 36 of an inserted spring clip 30, after being so positioned, extend over and press against each of the chip carrier cases 12 in the surrounding cavities 22. Note that the area of any one arm 36 in contact with the case 12 is minimized because the upturned end 37 directs all the force exerted by the arm 36 to a single line on the case 12.

In the manufacture of the semiconductor chip carriers 10, the components of the carriers are deposited into the cavities 22 of the pallet 20 (see FIG. 2*a*). Each lid 14, which is typically deposited first, rests on the bottom ledge 23 of the cavity 22 in which it sits. Each case 12, in turn, is deposited to overlie an associated lid 14. The eutectic alloy 15, which was previously applied on the periphery of a major surface of each lid 14, lies in between each lid 14 and case 12.

A plurality of the spring clips 30 are then inserted into the passages 24 of the pallet 20 as described previously. Each spring clip 30 secures in place all the unsealed chip carriers 10 in the cavities 22 surrounding the spring clip 30. Furthermore, the arms 36 of the spring clips 30 secure the cases 12 onto their associated lids 14 and provide a force which prevents relative movement therebetween during reflow of the eutectic material.

The pallet 20, now fully loaded, is placed in a furnace in order to reflow the eutectic alloy 15. A hermetic seal is formed between each lid 14 and case 12 as the chip carriers 10 are subsequently cooled.

After cooling, the spring clips 30 are removed from the pallet 20. The shaft 32 of each spring clip 30 is rotated 90° in order that the long dimension of its lower end 38 disengages the shoulders 25 of the passage 24 it is inserted in and aligns with the length of the passage 24 opening. The spring clips 30 are then slidably removed from the passages 24. Immediately thereafter, the newly sealed chip carriers 10 are also removed from the cavities 22.

It is to be understood that the embodiments described herein are merely illustrative of the principles of the invention. Various modifications may be made thereto by persons skilled in the art without departing from the spirit and scope of the invention.

For instance, although the instant embodiment is set forth in terms of a manual operation it is not so limited. An automated operation is described in a copending patent application entitled "A Method and Apparatus for Automated Spring Clip Insertion and Removal" to J. S. Cartwright filed in the U.S. Patent and Trademark Office on even date herewith, assigned to the instant assignee, and is incorporated by reference herein.

Additionally, the exemplary embodiment used a spring clip 30 that holds four chip carriers 10 in the cavities 22 of the pallet 20; however, it should be clear that the clips could be adapted to readily secure a smaller or larger number of carriers on the pallet. Furthermore, the pallet 20 can be arranged to handle a larger or smaller array of chip carriers 10 than is shown in the exemplary embodiment of FIG. 2*a*.

What is claimed is:

1. An apparatus for securing a plurality of articles in place on a substrate, said apparatus comprising:

(a) an elongated central member having first and second ends;

(b) means at the first end of the central member for lockably engaging the substrate; and (c) a plurality of resilient arms, extending radially out from the central member, for contacting and securing the articles on the substrate when the first end of the central member is lockably engaged therewith.

2. The apparatus as set forth in claim 1 wherein first ends of each of the arms are fixedly connected at the central member and are substantially co-planar.

3. The apparatus as set forth in claim 2 wherein each of the arms slopes away from the central member and is spaced from the other arms, so as to capture one of a plurality of the articles between each of the arms and the substrate when the first end of the central member is lockably engaged therewith.

4. The apparatus as set forth in claim 3 wherein each article is a semiconductor chip carrier having a case, a lid and a reflowable bonding material therebetween which are held in intimate contact by said apparatus.

5. A spring clip for securing a plurality of articles in place on a pallet, said spring clip comprises:

(a) an elongated central member having first and second ends;

(b) means at the first end of the central member for lockably engaging the pallet;

(c) means at the second end of the central member for transferring rotational motion to the central member;

(d) a plate having an opening therein through which the central member extends; and (e) a plurality of resilient arms, extending radially out from the plate for contacting and securing the articles on the pallet when the first end of the central member is lockably engaged therewith.

6. The spring clip as set forth in claim 5 wherein each of the arms slopes away from the central member and is spaced from the other arms, so as to capture one of a plurality of the articles between each of the arms and the pallet when the first end of the central member is lockably engaged therewith.

7. The spring clip as set forth in claim 5 wherein the plate is adapted to be carried on the central member between a pair of annular spaced-apart shoulders thereon.

8. The spring clip as set forth in claim 5 wherein each article is a semiconductor chip carrier having a case, a lid and a reflowable bonding material therebetween which are held in intimate contact by said spring clip.

9. A spring clip for securing a plurality of articles in place on a pallet, said spring clip comprises:

(a) an elongated central member having first and second ends;

(b) means at the first end of the central member for lockably engaging the pallet;

(c) means at the second end of the central member for transferring rotational motion to the central member;

(d) a plate having an opening therein through which the central member extends and adapted to be carried on the central member between a pair of annular spaced-apart shoulders thereon; and (e) a plurality of resilient arms extending radially out from the plate, each of the arms being sloped away from the central member and spaced from the other arms, so as to capture one of a plurality of the articles between each of the arms and the pallet when the first end of the central member is lockably engaged therewith.

10. The spring clip as set forth in claim 9 wherein each article is a semiconductor chip carrier having a case, a lid and a reflowable bonding material therebetween which are held in intimate contact with said spring clip.

11. The spring clip as set forth in claim 5 wherein the means at the first end comprises a first oblong member integral with the first end having a long dimension normal to the central member; and the means at the second end comprises a second oblong member integral with the second end and having a long dimension normal to the central member, the long dimension of the first oblong member being oriented ninety degrees from the long dimension of the second oblong member.

12. A spring clip for securing a plurality of articles in place in a pallet, said spring clip comprises:

(a) an elongated central member having first and second ends;

(b) the first end of the central member having an integral first oblong member with a long dimension normal to the central member and sized and shaped for lockable engagement in the pallet;

(c) the second end of the central member having an integral second oblong member with a long dimension normal to the central member and sized and shaped for transferring rotational motion to the central member, the long dimension of the second oblong member being oriented ninety degrees from the long dimension of the first oblong member;

(d) a plate which has the central member extending perpendicularly therethrough and adapted to be carried on the central member between a pair of annular spaced-apart shoulders thereon; and (e) a plurality of resilient arms extending radially out from the plate, each of the arms being sloped away from the central member and spaced from the other arms, so as to capture one of a plurality of the articles between each of the arms and the pallet when the first oblong member of the first end of the central member is lockably engaged therewith.

13. The spring clip as set forth in claim 12 wherein each article is a semiconductor chip carrier having a case, a lid and a reflowable bonding material therebetween which are held in intimate contact by said spring clip.

14. A spring clip for securing a lid to a case in a pallet, during heating, as solder interposed therebetween is reflowed to form a hermetic seal, comprising:

(a) an elongated central member having first and second ends;

(b) the first end of the central member having an integral first oblong member with a long dimension normal to the central member and sized and shaped for lockable engagement with a corresponding one of a plurality of receiving passages in the pallet;

(c) the second end of the central member having an integral second oblong member with a long dimension normal to the central member and sized and shaped for facilitating rotation of the central member, the long dimension of the second oblong member being oriented ninety degrees from the long dimension of the first oblong member;

(d) a plate which has the central member extending perpendicularly therethrough and adapted to be carried on the central member between a pair of annular spaced-apart shoulders thereon; and (e) a plurality of resilient arms extending radially out from the plate, each of the arms being sloped away from the central member and spaced from the other arms, so as to capture one of a plurality of the articles between each of the arms and the pallet when the first oblong end of the first end of the central member is lockably engaged therewith.

15. A method of securing a plurality of articles in place on a substrate, said method comprising:

(a) lockably inserting a first end of an elongated member in the substrate; and (b) simultaneously capturing the articles between the substrate and a plurality of arms extending radially out from the elongated member.

16. A method of securing a plurality of articles in place on a substrate, having an array of passages therein, said method comprising:

(a) inserting a spring clip, having an elongated central member with first and second oblong ends whose long dimensions are normal to the central member and oriented ninety degrees from one another, and a plurality of resilient arms extending therefrom, into one passage in the substrate;

(b) positioning a first end of each of the arms of the spring clip to extend over a corresponding one of a plurality of articles such that each first end, upon contact, exerts a force upon each article during insertion; and (c) locking the inserted spring clip in the passage so as to cause the articles to be captured between the first ends of the arms and the substrate.

17. The method as recited in claim 16 wherein each article is a semiconductor chip carrier having a case, a lid and a reflowable bonding material therebetween which are held in intimate contact by said spring clip.

18. The method as recited in claim 16 wherein said inserting comprises:

(a) rotating the second end of the central member of the spring clip and the central member affixed thereto, so as to align the long dimension of the first oblong end with the length of the surface opening of a passage in the substrate which is sized and shaped to accept the first oblong end; and (b) slidably urging the aligned first oblong end into the passage.

19. The method as recited in claim 18 wherein said locking comprises rotating the second end of the central member of the spring clip, and thereby the central member, until the long dimension of the inserted first oblong end effectively engages a shoulder within the passage whereby the central member is lockably held within the passage.

20. The method as recited in claim 19 wherein each article is a semiconductor chip carrier comprising a case, a lid and a reflowable bonding material therebetween which are held in intimate contact by said spring clip.

* * * * *